United States Patent [19]

Battigelli et al.

[11] Patent Number: 4,744,810

[45] Date of Patent: May 17, 1988

[54] PROCESS FOR FORMING FIBER MATS

[75] Inventors: Jean A. Battigelli; Francois Bouquet, both of Rantigny, France

[73] Assignee: Isover Saint-Gobain, Paris La Défense, France

[21] Appl. No.: 846,475

[22] Filed: Mar. 31, 1986

Related U.S. Application Data

[63] Continuation of Ser. No. 603,665, Apr. 26, 1984, abandoned, which is a continuation-in-part of Ser. No. 404,327, Aug. 2, 1982, abandoned.

[30] Foreign Application Priority Data

Aug. 6, 1981 [FR] France ..... 81 15283

[51] Int. Cl.[4] ..... C03B 37/022

[52] U.S. Cl. ..... 65/3.43; 65/4.4; 65/5; 65/7; 264/6; 264/7; 264/12; 264/518; 264/114; 264/115; 264/121; 264/126

[58] Field of Search ..... 406/47, 88, 91, 93, 406/151, 153, 147, 148; 264/518, 121, 126, 128, 6, 7, 12, 571, 114, 115; 65/9, 4.4, 3.43, 5

[56] References Cited

U.S. PATENT DOCUMENTS

| | | | |
|---|---|---|---|
| 3,325,906 | 6/1967 | Franke | 34/10 |
| 3,442,633 | 5/1969 | Perry | 65/9 |
| 3,781,047 | 9/1976 | Contractor et al. | 65/9 |
| 3,824,086 | 7/1974 | Perry et al. | 264/112 |
| 3,877,911 | 4/1975 | Borst | 65/3.43 |
| 4,087,267 | 5/1978 | Goutte et al. | 264/121 |
| 4,111,672 | 9/1978 | Battigelli et al. | 65/4.4 |
| 4,135,767 | 1/1979 | Hench et al. | 406/88 |
| 4,263,007 | 4/1981 | Battigelli et al. | 425/446 |
| 4,263,241 | 4/1981 | Alexandrov et al. | 264/121 |
| 4,350,482 | 9/1982 | Alexandrov et al. | 264/121 |

FOREIGN PATENT DOCUMENTS

| | | | |
|---|---|---|---|
| 0072301 | 2/1983 | European Pat. Off. | 264/121 |
| 1635596 | 3/1971 | Fed. Rep. of Germany . | |
| 2286772 | 4/1976 | France | 406/153 |
| 2413204 | 7/1979 | France . | |
| 0517072 | 1/1940 | United Kingdom | 264/121 |
| 1601801 | 11/1981 | United Kingdom | 406/93 |
| 0787537 | 12/1980 | U.S.S.R. | 264/121 |

*Primary Examiner*—Jan H. Silbaugh
*Assistant Examiner*—Hubert C. Lorin
*Attorney, Agent, or Firm*—John T. Synnestvedt; Kenneth P. Synnestvedt

[57] ABSTRACT

Fiber mats formed by attenuating molten streams of attenuable mineral material by subjecting the streams to the action of a hot attenuating gas blast. The gas blast induces gas from the surrounding atmosphere, and the combined blast and induced gas forming a fiber-carrying current. The current is directed toward a preforated fiber-collecting conveyor on which the fibers are deposited in the form of a mat and the gas of the current passes through the conveyor. Provision is made for withdrawing a peripheral portion of the fiber-carrying current at a point intermediate the zone of attenuation and the perforated fiber-collecting conveyor.

4 Claims, 3 Drawing Sheets

PROCESS FOR FORMING FIBER MATS

The present application is a continuation of prior application Ser. No. 603,665, filed Apr. 26, 1984, now abandoned, which is a continuation-in-part of prior application Ser. No. 404,327, filed Aug. 2, 1982, now abandoned. The disclosures of said prior applications are hereby incorporated in the present application by reference.

BACKGROUND AND STATEMENT OF OBJECTS

The technique of the present invention is applicable to a variety of systems for forming fiber mats, particularly where the mat is formed on a perforated fiber-collecting conveyor. One of the most widely used techniques of this type comprises a system especially adapted to the formation of glass fiber mats by centrifugally and radially projecting molten streams of the attenuable mineral material, especially molten glass, the molten streams being subjected to the attenuating action of a hot attenuating blast directed into the path of the centrifugally-projected streams, to thereby attenuate the streams to form fibers while the streams are in the molten or attenuable state. In this type of well-known fiber producing technique, the attenuated fibers are entrained in the attenuating gas blast, and the fiber-laden blast is exposed to the surrounding atmosphere, and in consequence, air is induced into the flow, thereby producing what is commonly referred to as a fiber-laden gas current. This current is directed against the surface of a perforated fiber-collecting conveyor, thereby resulting in passage of the gas of the current through the conveyor and depositing of the fibers on the conveyor surface.

It is also customary in an installation of the kind just referred to to subject the fiber-laden gas current to the spraying of liquids, especially a fiber binder material commonly comprising a thermosetting binder material which, when cured and solidified in the mat of fibers acts to stabilize the mat and provide an integrated, readily handleable fibrous mat. The perforated conveyor employed for the above purpose also delivers the formed mat to a curing oven in which the mat is subjected to heating for the purpose of setting or curing the binder or binding agent initially applied to the fibers when being carried by the fiber-laden gas current above-referred to.

As above-indicated, although the technique of the present invention is applicable to a wide variety of fiberization and mat-forming operations, the invention is particularly well-suited to use in a system of the kind referred to and therefore in the following description and also in the accompanying drawings, the features of the invention are disclosed as applied to a fiberization and mat-forming technique of the kind briefly described above.

In order to accomplish a number of improvements in the mat formation, the present invention provides a technique for withdrawing a peripheral portion of the fiber-laden gas current, this withdrawal being effected at a point downstream of the fiber attenuation zone and upstream of the depositing of the fibers from the gas-laden current upon the perforated conveyor. Several desirable objectives are achieved by this peripheral withdrawal of a portion of the fiber-laden gas current. One of these objectives is to reduce the compacting action resulting from directing of the fiber-laden current against the perforated fiber-collecting conveyor, and in consequence of this reduction, the mat is of lower density while being carried by the conveyor. Subsequently the mat may be fed between conveyors in a curing oven in which the desired dimensions and compacting may be more precisely established.

Another objective is achieved by locating the gas withdrawal equipment at a point intermediate the zone where attenuation occurs and the zone where the binder spray is applied to the fibers in the fiber-laden gas current. By withdrawing a peripheral portion of the fiber-laden current intermediate the attenuation and the application of the binder, the temperature of the current is reduced in the region downstream of the application of the binder and also from that zone downstream to the perforated conveyor. In consequence of this, the tendency for the thermosetting binder to be prematurely hardened while the mat is on the conveyor is reduced.

The foregoing and numerous other objectives and advantages will appear more clearly after consideration of the accompanying drawings and the following description of those drawings.

DETAILED DESCRIPTION OF THE DRAWINGS

Figure 1:
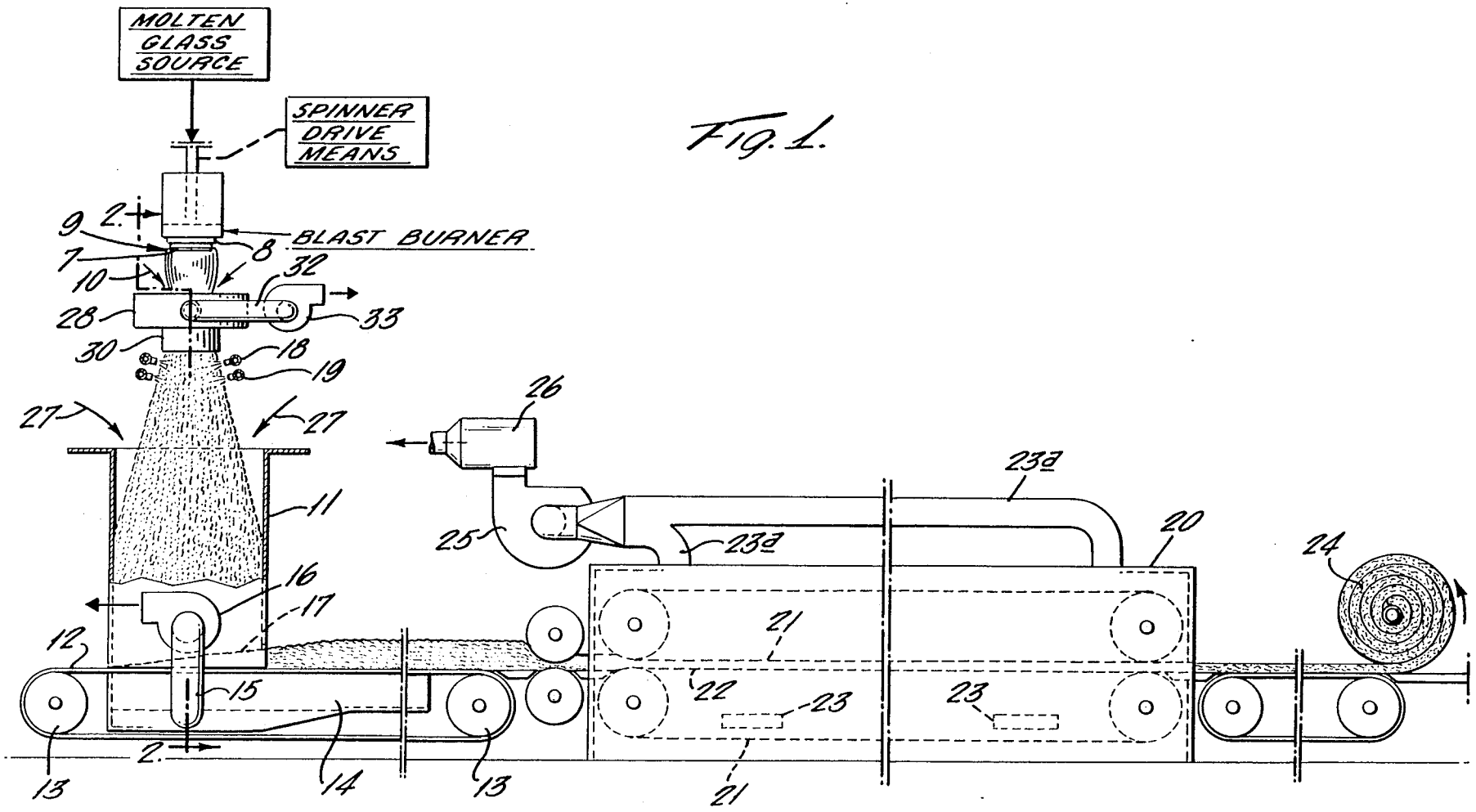
FIG. 1 is a somewhat diagrammatic side elevational view, with certain parts in vertical section, illustrating the overall equipment of a plant of the kind generally referred to above for the production and attenuation of fibers and the formation of fiber mats from these fibers, this view also indicating in outline the arrangement of the equipment provided by the invention for withdrawing a portion of the fiber-laden gas current from the periphery of that current.

In connection with the drawings, it is first pointed out that the drawings illustrate the application of the invention to the well-known centrifugal spinner type of glass fiber production. In an installation of this type, the centrifugal spinner is hollow and is usually mounted for rotation on an upright axis. A stream of glass is fed into the interior of the spinner and is delivered to the inside surface of a peripheral wall of the spinner in which a multiplicity of orifices are provided, so that streams or "primaries" of the molten glass are projected radially from the spinner. Provision is made for delivering an annular blast of hot attenuating gas downwardly from an annular orifice positioned just above and close to the perforated peripheral wall of the spinner; and this annular blast effects the attenuation of the glass streams into fibers.

The details of such well-known centrifugal spinner type of fiber production are not disclosed herein, but the general location and interrelationship of the principle constituents of the system are indicated in the drawings, as will now be explained with particular reference to FIGS. 1 and 2.

In FIG. 1 a block diagram representation is indicated for several of the components of a production plant. Thus at the top of the figure the location of a "Molten Glass Source" is indicated, and the molten glass is indicated as being delivered downwardly through the center of a "Spinner Drive Means", ordinarily comprising a hollow vertical shaft through which the glass is delivered downwardly from the source into the spinner itself which is indicated in the drawings by the reference numeral 7.

The attenuating blast is ordinarily developed by means of what is referred to as a "Blast Burner", as indicated in FIG. 1, and the blast burner has a nozzle structure indicated at 8 which delivers an annular blast of the attenuating gas downwardly just outside of the periphery of the spinner 7. The action of the blast attenuates the molten streams which are centrifugally projected from the spinner wall, and the blast stream carrying the attenuated fibers is indicated at 9. The blast also induces air or gas from the surrounding atmosphere, as is the case with any jet or blast delivered into the atmosphere from a nozzle aperture. Arrows indicating such induction of the surrounding atmosphere are shown at 10. The blast and the induced air thus form a fiber-laden current which continues on its course downwardly into a hood or chamber 11 for deposit of the fibers toward the bottom of the hood upon a perforated fiber-collecting conveyor diagrammatically indicated at 12. As shown in FIG. 1, this conveyor 12 comprises an endless perforated conveyor belt mounted as by the rotative supports 13 so that the perforated conveyor extends across the bottom of the hood 11. A suction box 14 positioned below the conveyor between the upper and lower runs thereof is upwardly open to the under side of the upper run of the conveyor 12. A suction connection 15 delivers the withdrawn gases by means of a suction fan 16.

As is well understood in this art, the travel of the fiber-laden current downwardly into the hood and against the upper surface of the perforated conveyor 12 results in deposit of the fibers on the conveyor, while the gases flow through the accumulating fibers and the conveyor and are withdrawn by the suction fan 16. The fiber mat or blanket formed in this manner is indicated at 17.

In an installation of the kind referred to, certain liquids are commonly sprayed on the fibers being carried in the fiber-laden current. In the embodiment illustrated, water spray nozzles are indicated at 18 and binder spray nozzles are indicated at 19. The binder material is customarily a thermosetting resin type of binder which is sprayed upon the fibers being carried downwardly and deposited on the conveyor 12. The mat or blanket of the fibers is carried out of the hood 11 by the conveyor 12 which serves to deliver the mat or blanket into one end of a curing oven diagrammatically indicated in FIG. 1 at 20. Any of a variety of curing ovens may be employed in a system in which the features of the invention are used, but the curing oven diagrammatically indicated at 20 in FIG. 1 is of the type disclosed in our prior U.S. Pat. No. 4,263,007,, issued Apr. 21, 1981. The details of construction of that oven need not be considered herein, but the disclosure of that oven in said prior patent is hereby incorporated in the present application by reference. Briefly, the general arrangement of the curing oven is as follows.

Within the oven 20 upper and lower endless conveyor belts are mounted and arranged with adjoining runs 21 and 22 between which the formed mat is received and carried lengthwise through the oven 20. Curing air circulation means are provided, including hot air inlets indicated diagrammatically at 23 in the lower portion of the oven, and offtake connections from the upper part of the oven, as indicated at **23*a*. In this way provision is made for circulation of a binder curing gas through the blanket and thus effect the desired curing or setting of the binder on the fibers. The structure of the mat or blanket is thus stabilized, as is well known. Upon delivery of the blanket from the curing oven 20, successive portions or lengths of the blanket are wound to form rolls such as indicated at 24** for shipping, storage, handling and the like.

The curing gases withdrawn from the curing oven are customarily delivered from the oven by means of a fan 25 which may discharge the gases through purification equipment diagrammatically indicated at 26.

Fiber production plants or installations of the kind referred to are well known and the details of the construction thereof need not be considered herein. The equipment and method of the present invention are, however, related to various aspects of such known systems, and particular reference is now made to portions of this equipment shown in FIGS. 1, 2 and 3.

It is first pointed out that as is known in connection with gas blast attenuation of molten streams of glass centrifugally from a spinner, the downwardly directed blast is initially of annular form, with a hollow interior. As this blast progresses, the overall outside diameter of the annular current diminishes, notwithstanding the induction of gas into the outer peripheral surface of the blast, and this configuration is shown in FIGS. 1, 2 and 3. As the current progresses downwardly and additional air is induced as indicated at 27 in FIGS. 1 and 2, the blast and the induced gas flow fill the entire cross-sectional area of the current and the overall outside diameter of the current progressively increases as is clearly shown in FIGS. 1 and 2, until the walls of the hood 11 are encountered.

For purposes referred to above and also more fully explained hereinafter, the present invention provides for withdrawal or separation of a portion of the current at a point in the downward flow of the current lying between the zone in which the fibers are attenuated, and the zone in which the fibers are deposited on the perforated conveyor 20 at the bottom of the hood 11. In all embodiments of the invention the withdrawal of a portion of the current occurs in the outer or peripheral region of the current.

Figure 2:
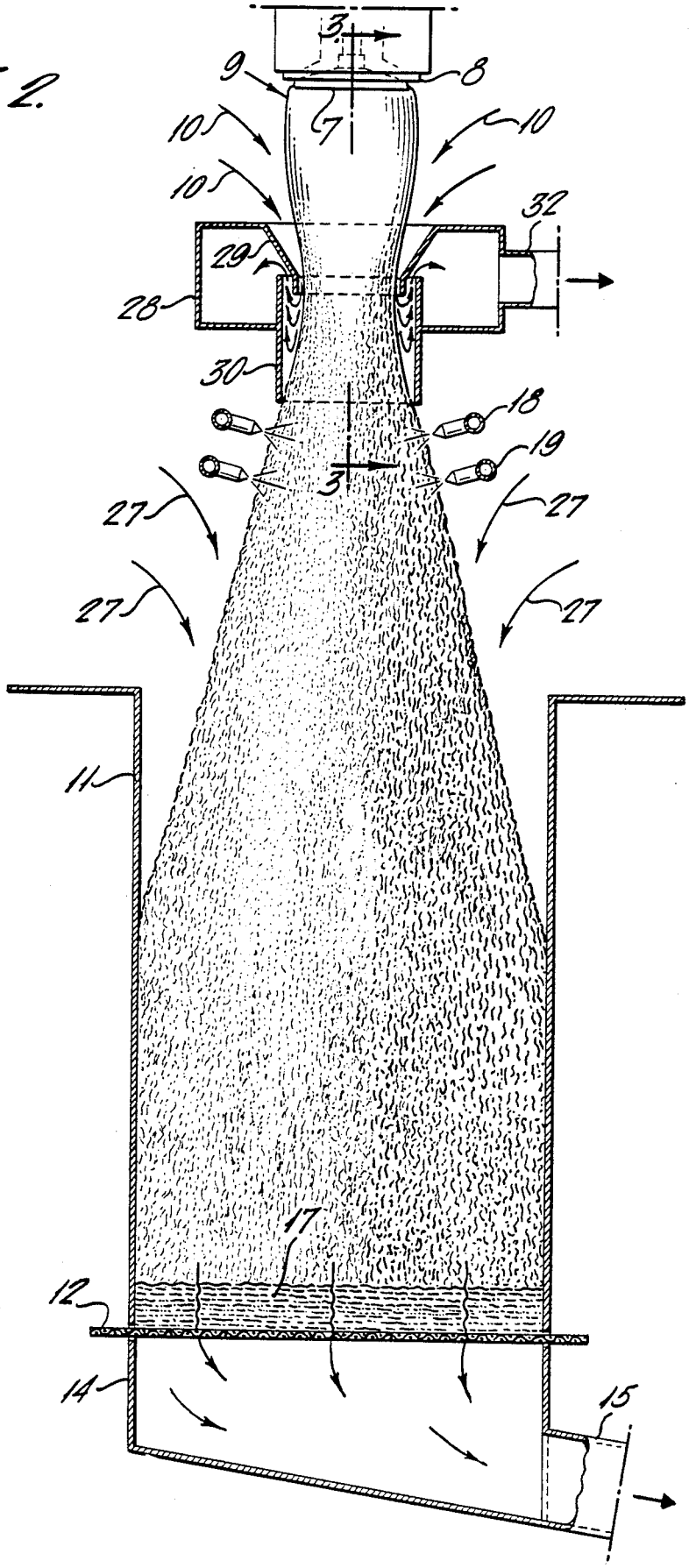
FIG. 2 is an enlarged vertical sectional view taken substantially as indicated by the section line 2—2 on FIG. 1.
Figure 3:
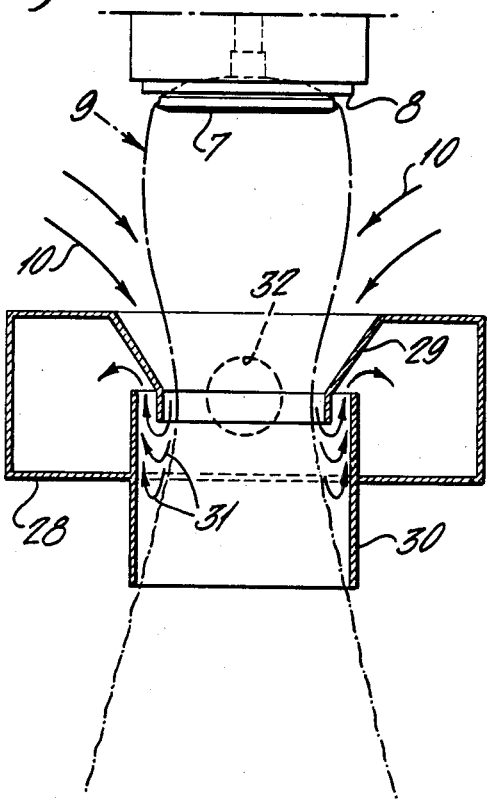
FIG. 3 is a further enlarged vertical sectional view of the gas withdrawal equipment incorporated in the production set-up shown in FIGS. 1 and 2, FIG. 3 being taken as indicated by the section line 3—3 on FIG. 2.

In the embodiment of FIGS. 1, 2 and 3, this is accomplished by the provision of an annular suction chamber 28 surrounding the path of the fiber-laden current and having a downwardly inclined inner wall 29 close to the path of the current, and also having a cylindrical inner wall 30, the lower end of which is open and the upper end of which surrounds the lower edge of the wall 29 in spaced relation thereto, thereby providing an annular suction passage adapted to withdraw a peripheral portion of the current in a path as indicated by the flow arrows 31. The separated or withdrawn portion of the current enters the annular suction chamber 28 and is withdrawn therefrom through the connection 32 which, as shown in FIG. 1, is associated with a suction fan diagrammatically illustrated at 33.

By the suction means just described, an outer peripheral layer of the fiber-laden current is withdrawn. This action has a number of desirable effects in the production of glass fiber mats or blankets, including the following.

In considering the effect of withdrawal of a portion of the fiber-laden current from the periphery of the current, it is first pointed out that in the absence of such withdrawal all of the current including not only the initial attenuating blast but also the induced gas flows downwardly through the mat being formed on the perforated conveyor and through the perforated conveyor itself for withdrawal by the suction means under the conveyor. The volume and the dynamic inertia of the combined gases of the current are substantial and have a tendency to compress the mat being formed to a greater extent than is preferred at that stage of the formation of the mat. In addition, in the absence of withdrawal of a peripheral portion of the current, there is a tendency for the temperature of the current passing through the mat being formed and thus of the mat itself on the perforated conveyor to be higher than preferred, especially where a thermosetting or binder resin is sprayed upon the fibers in the current.

The withdrawal of a peripheral portion of the current in a zone spaced well above the porous fiber-collecting conveyor, but downstream of the zone of attenuation of the fibers favorably influences the mat-forming conditions both with respect to the temperature conditions and also with respect to the tendency for excessive compression of the mat while it is being collected on the perforated conveyor. In analyzing these characteristics, the following points should be kept in mind.

First, the withdrawal of a peripheral portion of the fiber-laden current results in an increase in the overall induction of gas from the surrounding atmosphere. Indeed, the peripheral withdrawal substantially increases the quantity of gas induced in the region upstream of the zone of peripheral withdrawal. The increase in the quantity of induced gas results in a reduction in the average temperature of the current as it approaches and reaches the perforated fiber-collecting conveyor. The reduction in temperature of the gases passing through the conveyor is desirably sufficient to provide a temperature in the mat being formed lower than 90° C. and preferably lower than 80° C.

Moreover, the increase in the amount of induced gas in the current also tends to decrease the average velocity and thus the average dynamic inertia of the gases approaching and passing through the perforated conveyor. The reason for these changes in the sense just referred to lies in the fact that the proportion of the gases which are induced in relation to the original attenuating blast is increased. The velocity of the gases entering the mat being formed is desirably less than 6 m/s, and most advantageously less than 3 m/s. The induced gases, of course, have lower temperature and lower velocity than the attenuating blast, and these factors bring about a lowering of the temperature of the gases passing through the mat being formed on the perforated conveyor and also a lowering of the volume of flow and dynamic inertia of those gases at the level of the perforated conveyor, with consequent reduction in tendency to excessively compress the mat while it is being formed.

With respect to the quantity of gas withdrawn from the periphery of the fiber-laden current, it is desirable to observe certain limitations or preferred ranges. In the first place, it is desirable that the zone from which the gases are withdrawn should be spaced downstream of the attenuating zone beyond the zone in which the glass of the fibers being formed is still molten. Preferably the zone of withdrawal is spaced downstream of the attenuating zone beyond the region in which the volume of the induced gas is at least twice the volume of the attenuating blast.

With respect to the quantity of the gas to be withdrawn, it is preferred that that quantity be less than the volume of the current in the absence of the peripheral gas removal, for instance in the neighborhood of about 60% of the volume of the current in the absence of the peripheral removal of gas.

Still further it is important that the quantity of gas removed should not be sufficient to withdraw any substantial quantity of fibers with the removed gas, as this would, of course, diminish the production rate. Peripheral removal of gas from the fiber-laden current should not result in removal of more than 2% of the total fibers being produced, and preferably less than 2%. Most advantageously, the quantity of gas removed should not result in the removal of more than 1% of the fibers being produced. It is particularly important to operate under conditions minimizing the quantity of fibers removed because this minimizes the problem of separation of the fibers from the withdrawn gases, and thereby minimizes the problem of atmospheric pollution.

Several different forms of manifolds or suction devices may be utilized for the peripheral withdrawal of the gas. It is preferred in all cases that the equipment employed for this purpose should avoid withdrawal of any substantial quantity of gas from the interior of the fiber-laden current; and in order to avoid such undesirable action, the withdrawal equipment should be adapted to effect the withdrawal in a manner avoiding substantial turbulence so that the withdrawal will occur from the periphery of the current in the general manner indicated by the arrows 31 in FIG. 3.

Figure 4:
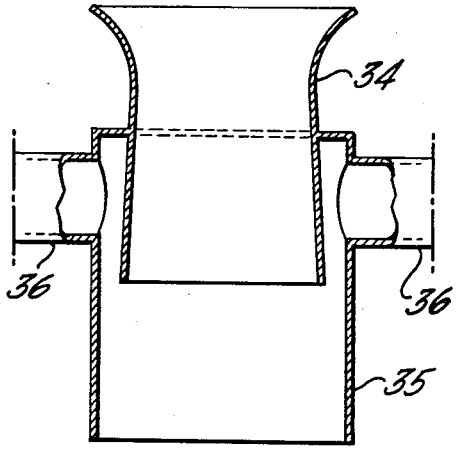
FIGS. 4, 5 and 6 are views similar to FIG. 3 but each illustrating an alternative embodiment of the equipment for withdrawing a peripheral portion of the gas current in order to accomplish the objectives of the invention.

In the alternative form of equipment shown in FIG. 4, a central tubular guide 34 is employed to receive the downwardly directed current in a manner similar to the tapered wall 29 of FIG. 3. The embodiment of FIG. 4 also includes a lower generally cylindrical housing 35 of somewhat larger diameter than the outside diameter of the tubular guide 34. One or more suction offtakes shown at 36 are provided and this provides for offtake of a peripheral layer of a current in the same general manner as indicated in FIG. 3.

Figure 5:
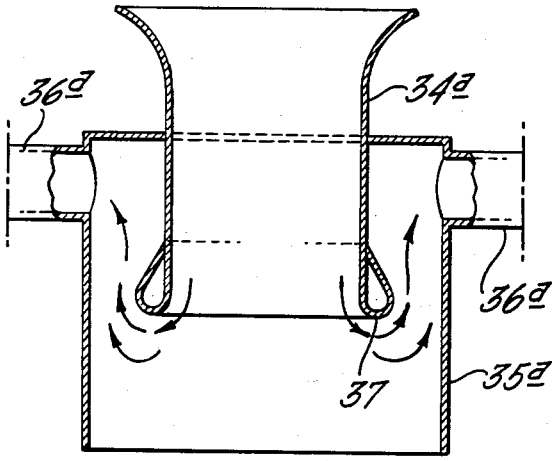

The embodiment shown in FIG. 5 is similar to the embodiment shown in FIG. 4, having a central tubular guide **34*a* and a surrounding cylindrical housing 35*a*, with offtakes 36*a***.

The action of the arrangement shown in FIG. 5 is generally similar to that of FIGS. 3 and 4, but in FIG. 5 another feature is illustrated. Thus, in FIG. 5 at the lower end of the central tubular guide **34*a*, a curved or streamlined edge portion 37 is provided. This extends around the lower end of the tubular guide 34*a*** and diminishes local eddy currents. In this way the tendency to agitate the interior portions of the current is diminished.

Figure 6:
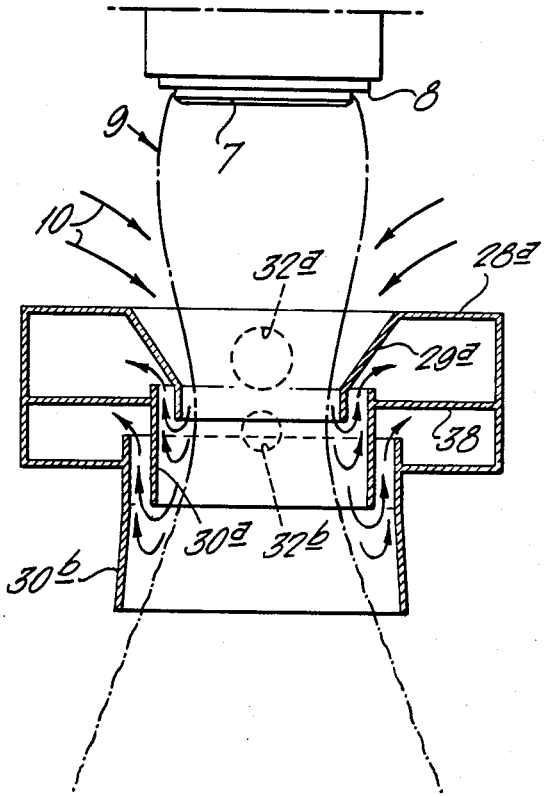

Still another alternative embodiment is illustrated in FIG. 6. Here an annular suction chamber **28*a* is provided having an overall general configuration similar to the annular chamber 28 of FIG. 3, but in FIG. 6 this chamber is divided by a horizontal partition 38, and each of the chambers above and below the partition has a suction connection as indicated at 32***a* and 32*b*. The downwardly inclined inner wall 29*a* cooperates with the upper portion of the cylindrical wall 30*a* in the same general manner as the parts 29 and 30 in FIG. 3.

In addition to the above, in the embodiment of FIG. 6 another tubular wall element 30*b* is provided in spaced relation around the lower portion of the wall 30*a*, thereby providing another annular suction outlet communicating with the chamber below the partition 38 in the annular suction chamber 28*a*. In this way provision is made for peripheral withdrawal of gases in two stages, instead of only in a single stage as in FIGS. 3, 4 and 5.

In all of the embodiments shown in FIGS. 3, 4, 5 and 6, it will be understood that the devices for withdrawing gas from the periphery of the current should be located in spaced relation downstream of the zone where attenuation is actually taking place, and preferably sufficiently downstream of the attenuation in order to permit substantial induction of gas from the surrounding atmosphere before the withdrawal is effected. It is also to be understood that in all cases substantial induction of additional gas downstream of the withdrawal zone is also contemplated. In this way the advantages above referred to with respect to reduction of temperature of the fiber-laden current in the zone of the perforated conveyor are attained. Moreover, all of these arrangements provide for reduction in the overall quantity of gas passing through the perforated mat-forming conveyor and also result in reduction in the velocity and thus the dynamic inertia of the gases in the process of depositing of the fibers on the conveyor.

All of these factors are, in turn, of importance in providing a mat of desirable characteristics for final formation in the curing oven and for avoidance of curing of the binder until the desired mat formation and configuration are established in the curing oven.

EXAMPLE

Comparative tests were conducted to determine certain effects of the technique of the invention on the gas currents.

These tests were effected in an installation containing a spinner for forming fibers. The general arrangement of this installation is diagramed in FIG. 1. The gas removal apparatus used was the type shown in FIGS. 1, 2 and 3.

The fiber forming conditions conform with those traditionally used for this type of apparatus. The flow chosen corresponds to a production of 14 tons of fibers daily (0.16 Kg/s).

The yields are expressed in terms of $m^3/h$ under standard conditions of pressure of 1 atmosphere (766 mm of mercury) and a temperature of 0° C.

Two series of tests were conducted; one (I) without the gas removal apparatus, and one (II) with the operation of the apparatus according to the invention.

The gas flows are measured at the entrance and exit of the peripheral withdrawal apparatus (or in the absence of the latter at the corresponding levels on the path of the fiber-laden current) at the level of the perforated conveyor and under the conveyor in the suction chamber.

The following table gives the results of the flow measurements made.

| | I | II |
|---|---|---|
| Attenuating blast | 1300 | 1300 |
| Induced before periheral withdrawal | 7000 | 9200 |
| Withdrawn | — | 5000 |
| Exit of the withdrawal apparatus | 8300 | 5500 |
| Induced after withdrawal | 21700 | 14500 |
| At level of conveyor | 30000 | 20000 |
| Induced under the conveyor | 12000 | 8500 |
| Withdrawn through suction box | 42000 | 28300 |

In the above table the values corresponding to the induced flows are calculated by subtraction. All other values are measured.

The withdrawal of a large quantity of gas as is the case in II involves an increase in the quantity of air induced upstream of the withdrawal. Nevertheless, the overall quantity of gas at the exit of the withdrawal apparatus is substantially reduced as compared to that which is measured without the withdrawal.

The effect of the energy or dynamic inertia reduction by the withdrawal is quite substantial on the quantities of air induced downstream of the withdrawal apparatus. The result is a large decrease (30%) in the quantity of gas which passes through the fiber mat. This decrease may be expressed by a decrease in the passage speed of the gas (3.4 m/s without withdrawal, 2.3 m/s with withdrawal) with the advantages pointed out concerning the compression of the fibers, the migration of the binding composition and the improvement of the final product.

The suction required at the level of the suction chamber under the receiving conveyor is much lower, which at the same time reduces the leakage air introduced because of leakage into the apparatus at this level (8500 $m^3/h$ of air instead of 12000 $m^3/h$ of air).

These combined effects lead to a quantity of effluent gas reduced to 28000 $m^3/h$ of air instead of 42000 $m^3/h$ of air, or a decrease of 32%.

Even if the air withdrawn is added to the air aspirated under the receiving element, for instance 33500 $m^3/h$ of air, the reduction is still greater than 20%. These decreases are quite substantial in the cost of operating the installation and they add to the improvements provided in the product itself.

We claim:

1. A method for forming glass fiber mats from attenuable molten glass comprising forming streams of the molten glass, stretching or attenuating said streams of molten glass by projecting the streams radially outwardly into a surrounding high-speed downwardly directed unconfined annular attenuating gas blast and thereby producing solidified attenuated glass fibers carried in said blast, the fiber-laden blast being exposed to the surrounding atmosphere and inducing gas from the surrounding atmosphere throughout the periphery of the blast and thereby providing an unconfined downwardly directed fiber-laden gas current with the induced gas in the peripheral region thereof, spraying a thermosetting binder material on the attenuated fibers carried in said gas current in a zone of said current downstream of the attenuation and solidification of the fibers, said current being directed toward a perforated fiber-collecting conveyor, thereby depositing the fibers in the form of a mat on the surface of the conveyor while gas of said current passes through the conveyor, aspirating said current after it passes through the perforated conveyor, and, in a zone downstream of the exposure of the fiber-laden blast to the surrounding atmosphere but upstream of the spraying of the thermosetting binder, removing an annular portion of said current from the peripheral region thereof.

2. A method for forming glass fiber mats from attenuable molten glass comprising forming streams of the molten glass, stretching or attenuating said streams of molten glass by projecting the streams radially outwardly into a surrounding high-speed downwardly directed unconfined annular attenuating gas blast and thereby producing solidified attenuated glass fibers carried in said blast, the fiber-laden blast being exposed to the surrounding atmosphere and inducing gas from the surrounding atmosphere throughout the periphery of the blast and thereby providing an unconfined downwardly directed fiber-laden gas current with the induced gas in the peripheral region of the attenuating blast and the fibers carried thereby, said fiber-laden blast inducing gas from the surrounding atmosphere in an amount greater than several times the volume of the attenuating blast, spraying a thermosetting binder material on the attenuated fibers carried in said gas curernt in a zone of said current downstream of the attenuation and solidification of the fibers, said current being directed toward a perforated fiber-collecting conveyor, thereby depositing the fibers in the form of a mat on the surface of the conveyor while gas of said current passes through the conveyor, aspirating said current after it passes through the perforated conveyor, and, in a zone downstream of the exposure of the fiber-laden blast to the surrounding atmosphere but upstream of the spraying of the thermosetting binder, applying suction around the periphery of the gas current and thereby removing an annular portion of said current from the peripheral region thereof.

3. A method as defined in claim 2 in which the fiber content of the gas removed from the periphery of the fiber-laden current is less than 2% of the total fibers being produced.

4. A method as defined in claim 2 in which the region of removal of said portion of the gas current is spaced downstream of the exposure of the blast to the atmosphere beyond the region in which the volume of the induced gas is at least twice the volume of the attenuating blast.

* * * * *